US007806303B1

(12) United States Patent
Hastings

(10) Patent No.: US 7,806,303 B1
(45) Date of Patent: Oct. 5, 2010

(54) SEALABLE POUR SPOUT

(76) Inventor: Mark Hastings, 13145 Madison Ave., Largo, FL (US) 33773

( * ) Notice: Subject to any disclaimer, the term of this patent is extended or adjusted under 35 U.S.C. 154(b) by 352 days.

(21) Appl. No.: 11/870,873

(22) Filed: Oct. 11, 2007

(51) Int. Cl.
*B67D 3/00* (2006.01)
*B67D 7/06* (2006.01)

(52) U.S. Cl. ..... 222/481.5; 222/484; 222/525; 222/521

(58) Field of Classification Search ..... 222/481.5, 222/482, 484, 478, 566, 567, 569, 562, 552, 222/519, 520, 521, 522, 523, 524, 525
See application file for complete search history.

(56) References Cited

U.S. PATENT DOCUMENTS

| | | | | | |
|---|---|---|---|---|---|
| 1,221,350 | A | * | 4/1917 | Miller | 222/482 |
| 2,405,681 | A | * | 8/1946 | Woock | 222/400.5 |
| 2,557,917 | A | * | 6/1951 | Schlesinger | 222/490 |
| 2,790,582 | A | * | 4/1957 | Halpern | 222/481.5 |
| 3,923,203 | A | * | 12/1975 | Anderson, Jr. | 222/153.03 |
| 4,108,336 | A | * | 8/1978 | Anderson, Jr. | 222/148 |
| 4,802,610 | A | | 2/1989 | Cheek et al. | |
| 4,807,785 | A | * | 2/1989 | Pritchett | 222/442 |
| 4,986,901 | A | * | 1/1991 | Nohren et al. | 210/85 |
| 5,042,698 | A | * | 8/1991 | Fessell | 222/481.5 |
| 5,133,482 | A | * | 7/1992 | Burrows et al. | 222/185.1 |
| 5,172,831 | A | * | 12/1992 | Burrows | 222/1 |
| 5,211,314 | A | * | 5/1993 | Burrows | 222/481.5 |
| 5,323,832 | A | * | 6/1994 | Burrows | 222/1 |
| 5,573,046 | A | * | 11/1996 | Venooker et al. | 141/285 |
| 5,586,560 | A | * | 12/1996 | Boutos | 128/845 |
| 5,961,001 | A | * | 10/1999 | Davis et al. | 222/153.06 |
| 6,123,225 | A | * | 9/2000 | Peckels | 222/1 |
| 6,364,178 | B1 | * | 4/2002 | Paczonay | 222/522 |
| 6,779,694 | B2 | * | 8/2004 | Young | 222/525 |
| 7,272,665 | B2 | * | 9/2007 | Yamada et al. | 710/3 |
| 2004/0178231 | A1 | * | 9/2004 | Kelley et al. | 222/525 |

* cited by examiner

*Primary Examiner*—Kevin P Shaver
*Assistant Examiner*—Stephanie E Williams
(74) *Attorney, Agent, or Firm*—Thomas E. Toner; Smith & Hopen, P.A.

(57) ABSTRACT

Disclosed herein is a sealable pour spout. The pour spout provides a conduit which allows liquid to leave a bottle and a vent which allows air to enter the bottle and replace the liquid. A cap moves vertically along the conduit which provides fluid communication with the interior of the bottle. When the cap is moved upward, the spout opens. A through hole in the side of the cap also allows fluid communication with the interior of the bottle. When the cap is depressed, a stopper occludes the pour hole and closes the spout. The vent is occluded, in the closed position, by the interior surface of the cap. Therefore, the interior of the bottle is completely sealed when the spout is in the closed position.

10 Claims, 8 Drawing Sheets

SEALABLE POUR SPOUT

BACKGROUND OF THE INVENTION

Pour spouts are commonly used in eating and drinking establishments to provide for the controlled pouring of liquids, particularly alcohol, from bottles. Pour spouts are almost universally used in these locations since they relieve drink preparers free from constantly opening and closing bottles. Moreover, pour spouts allow the user to carefully measure, by time, the amount of liquid being dispensed.

A typical pour spout consists of conduit which is open at its lower end, with a smaller opening at its upper end. A gasket around the lower end of the conduit provides a seal between the bottle and the conduit to ensure that the only liquid which exits the bottle is that which exits through the small opening at the upper end of the spout. Many pour spouts also include a vent which allows air to enter the bottle to replace the exiting liwuid.

While pour spouts provide tremendous advantages over opening and closing each bottle, existing pour spouts present significant challenges. Of greatest importance, a pour spout provides an opening between the interior of the bottle and the atmosphere. While necessary for dispensing liquids, this opening allows organisms such as gnats and fruit flies to enter the bottles when they are not in use.

There have been simple measures employed to overcome this challenge. For example, some establishments simply place disposable cups over the pour spouts at the end of each evening. This solution is not only unattractive, but wasteful. More sifisticated attempts include providing pour spouts with removeable caps. While sound in theory, the caps are often lost, are hard to keep clean and do not seal the vent.

SUMMARY OF INVENTION

The invention includes a sealable pour spout. The pour spout has a conduit, which permits liquid to leave the bottle. A lip extending from the conduit engages the neck of the bottle, preventing the pour spout from falling into the bottle. An outer through-hole is disposed in a side of the conduit at a position above the lip. A vent is placed within the conduit in fluid communication with the inner through-hole. A stopper is partially disposed within the first conduit, and extends to a point above the first conduit.

A cap is placed over the conduit, and slides between a closed position and an open position. The cap has a pour hole, which is preferably centrally apertured. The pour hole is in fluid communication with the conduit when the cap is in the open position. When the cap is depressed (the closed position) the stopper occludes the opening in the cap.

In a preferred embodiment, an outer through-hole is formed in the side of the cap.

The outer through hole is position such that it is in fluid communication with the inner through-hole, and by extension with the vent, when the cap is the open position. This configuration permits fluid communication between the inside of the bottle and the atmosphere when the cap is in the open position. When the cap is in the closed position the outer through hole is occluded by the outer surface of the conduit; the inner through hole is occluded by the inner surface of the cap.

In yet another embodiment, the cap further comprises an annular sleeve, having a smaller diameter, extending from the bottom thereof. This provides an ergonomic surface under the cap allowing the user to easily move the cap from the closed position to the open position with their thumb. A preferred embodiment has a cap further comprising a protrusion to enhance manual operation of the device.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
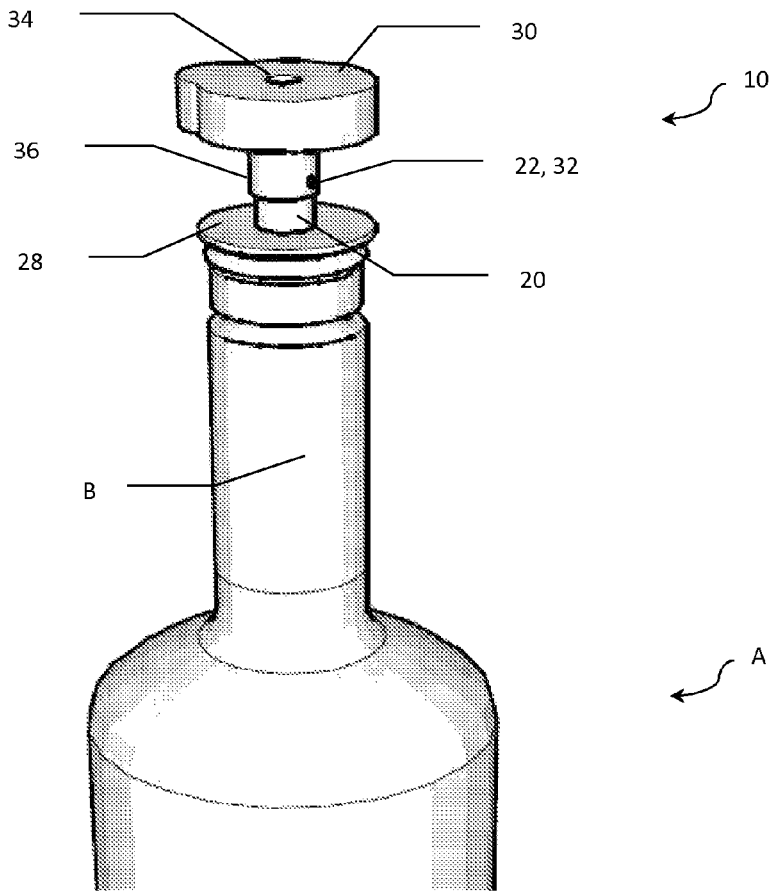
FIG. 1 is a perspective view of the inventive pour spout engaged with the neck of a bottle.

Referring now to FIG. 1, a preferred embodiment of sealable pour spout 10 is shown, as it would be in use, engaging neck B of bottle A. Here it can be seen that spout 10 comprises lip 28, which engages neck B of bottle A. Conduit 20 passes through lip 28, providing fluid communication between the interior and exterior of bottle A. Sleeve 36, connected to cap 30, slides over conduit 20. Pour hole 34 in cap 30 provides a point of egress for the liquid within bottle A.

Figure 2:
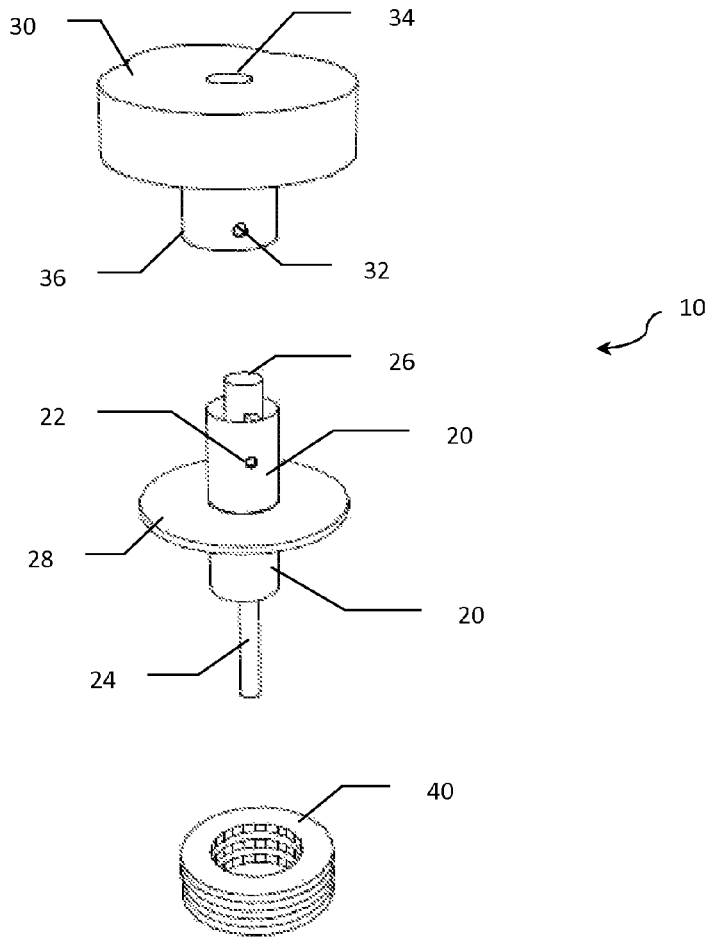
FIG. 2 is an exploded perspective view of the inventive pour spout.

FIG. 2 provides an exploded view of pour spout 10. As shown, pour spout 10 comprises central conduit 20 which extends from the inside of the bottle neck to a point above the upper most rim of the bottle. Stopper 26 is disposed partially within conduit 20 and extends upward past the superior end thereof. Lip 28 contacts the upper surface of the bottle, preventing conduit 20 from completely entering the bottle. Gasket 40 is attached to conduit 20 at a point below lip 28. Gasket 40 both secures conduit 20 within the neck of the bottle, as well as establishes a water-tight seal between the outer surface of conduit 20 and the neck of the bottle. When the bottle is inverted, liquid within the bottle exits the bottle through conduit 20.

Inner through-hole 22 is disposed in the side of conduit 20 at a point superior to lip 20. A second conduit (vent 24) is partially disposed within conduit 20. Vent 24 terminates at its superior end adjacent to, and in fluid communication with, through-hole 22. In a preferred embodiment, vent 24 terminates at its inferior end at a point below the inferior end of conduit 20. When the bottle and pour spout 10 are inverted, liquid is allowed to exit the bottle through conduit 20 and air is allowed to enter the bottle through vent 24.

Cap 30 is disposed in superior relation to conduit 20. Cap 30 contains pour-hole 34, which is preferably centrally apertured therein. Also in a preferred embodiment, annular sleeve 36 is attached to the bottom of cap 30 and disposed in fluid communication with pour hole 34. Sleeve 36 is appropriately proportioned to allow cap 30 and sleeve 36 to slide over the portion of conduit 20 which is above lip 28. Cap 30 and sleeve 36 "snap-on" conduit 20 but are moveable between an open (first) position and a closed (second) position.

When cap 30 is in the open position, pour hole 34 is in fluid communication with conduit 20, and by extension the interior of the bottle. When the bottle is inverted, liquid flows through conduit 20 and out pour spout 34. When cap 30 is in the closed position, pour hole 34 is occluded by stopper 26. In a preferred embodiment, stopper 26 is proportioned to enter, and seal, pour hole 34. Moreover, stopper 26 preferrably terminates at the upper edge of pour hole 34, when cap 30 is in the closed position, so that it is flush with the surface of cap 30. It possible for stopper 26 to occlude pour hole 34 by having a greater diameter, thereby sealing it from the bottom. It is also possible for stopper 26 to extend past the surface of cap 30. It is preferable, however, for stopper 26 to be flush with cap 30 to provide easier cleaning since bacteria and particulate matter can accumulate either in pour hole 34 or the portion of stopper 26 which extends past the surface of the cap.

Also in a preferred embodiment, outer through hole 32 is disposed in a side of sleeve 36 such that it is influid communication with inner through hole 22 when cap 30 is in the open position. In this embodiment, fluid communication with inner through hole 22 and vent 24 is terminated when cap 30 is place in the closed position. It is also possible, however, to provide fluid communication between vent 24 and the atmosphere by disposing sleeve 36 such that its inferior end is above inner through hole 22 when cap 30 is in the open position but occludes inner through hole 22 when cap 30 is in the closed position.

Figure 3A:
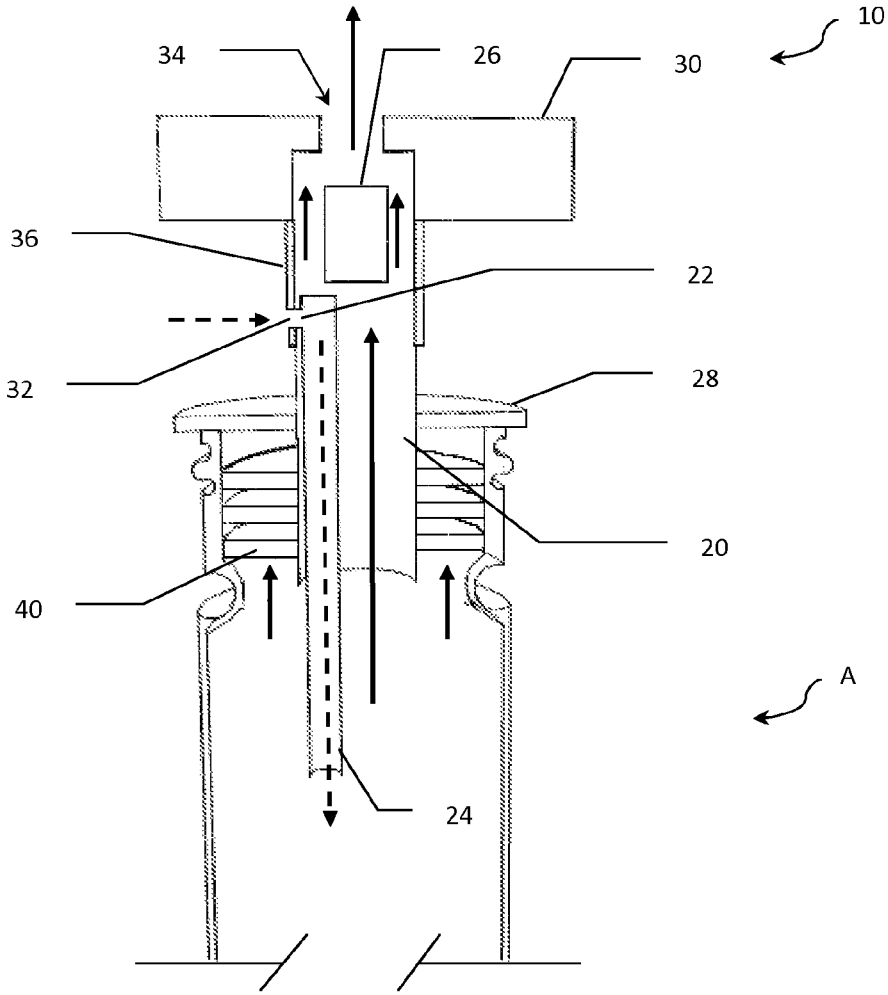
FIG. 3A is a cross-section of the inventive pour spout in the open position.
Figure 3B:
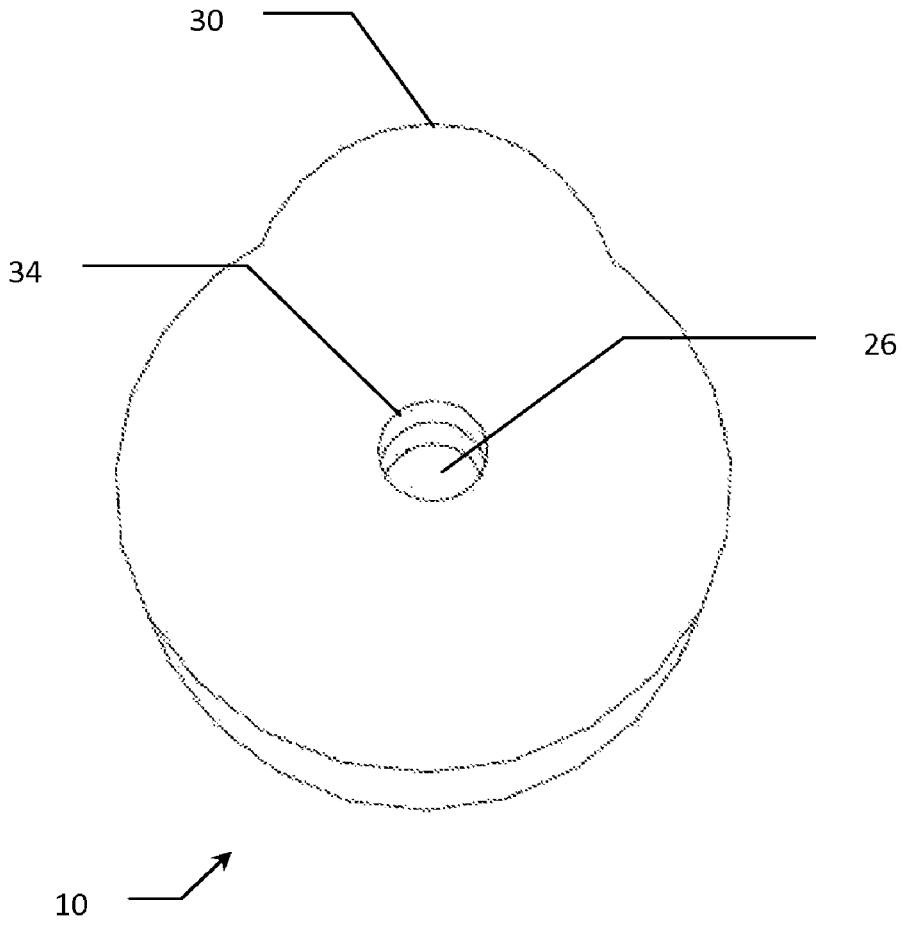
FIG. 3B is a top perspective view of the inventive pour spout in the open position.
Figure 3C:
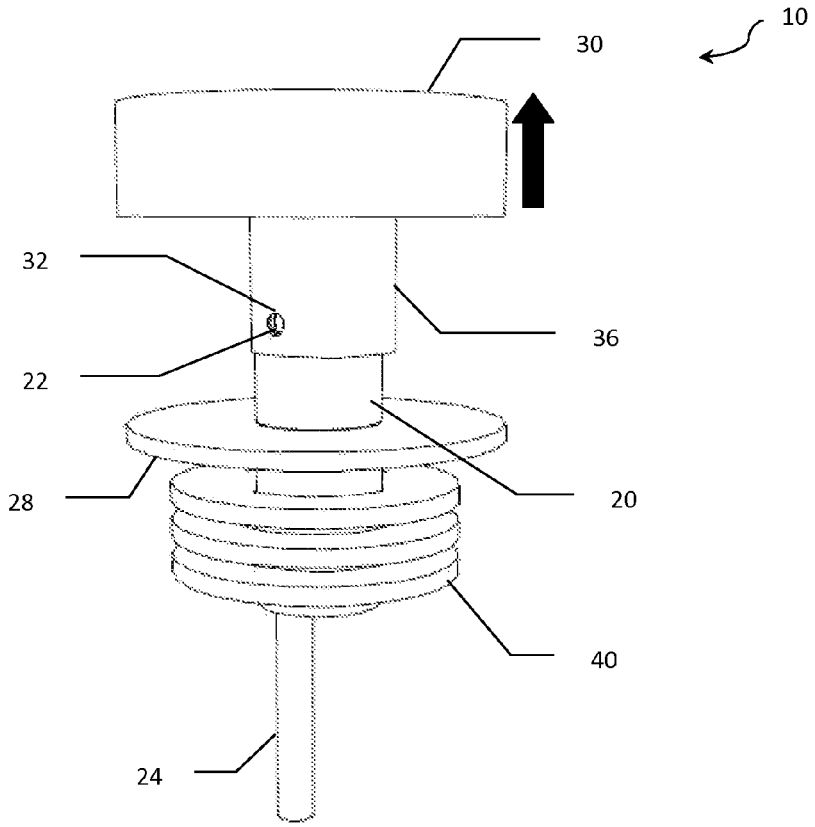
FIG. 3C is a side perspective view of the inventive pour spout in the open position.

FIGS. 3A through 3C show pour spout 10 in the open position. Referring now to FIG. 3A, which shows pour spout 10 engaged with neck B of bottle A; the flow of liquid from the bottle is indicated by solid black arrows, whereas the flow of air into the bottle is shown by hashed arrows. As it can be seen, liquid is prevented from exiting the bottle to the exterior of conduit 20 due to the seal formed by gasket 40. In the open position, liquid is free to travel through conduit 20, around stopper 26 into sleeve 36 and out pour hole 34 (see also FIG. 3B). Air is free to enter vent 24 through outer through hole 32 and inner through hole 22 (see also FIG. 3C).

Figure 4A:
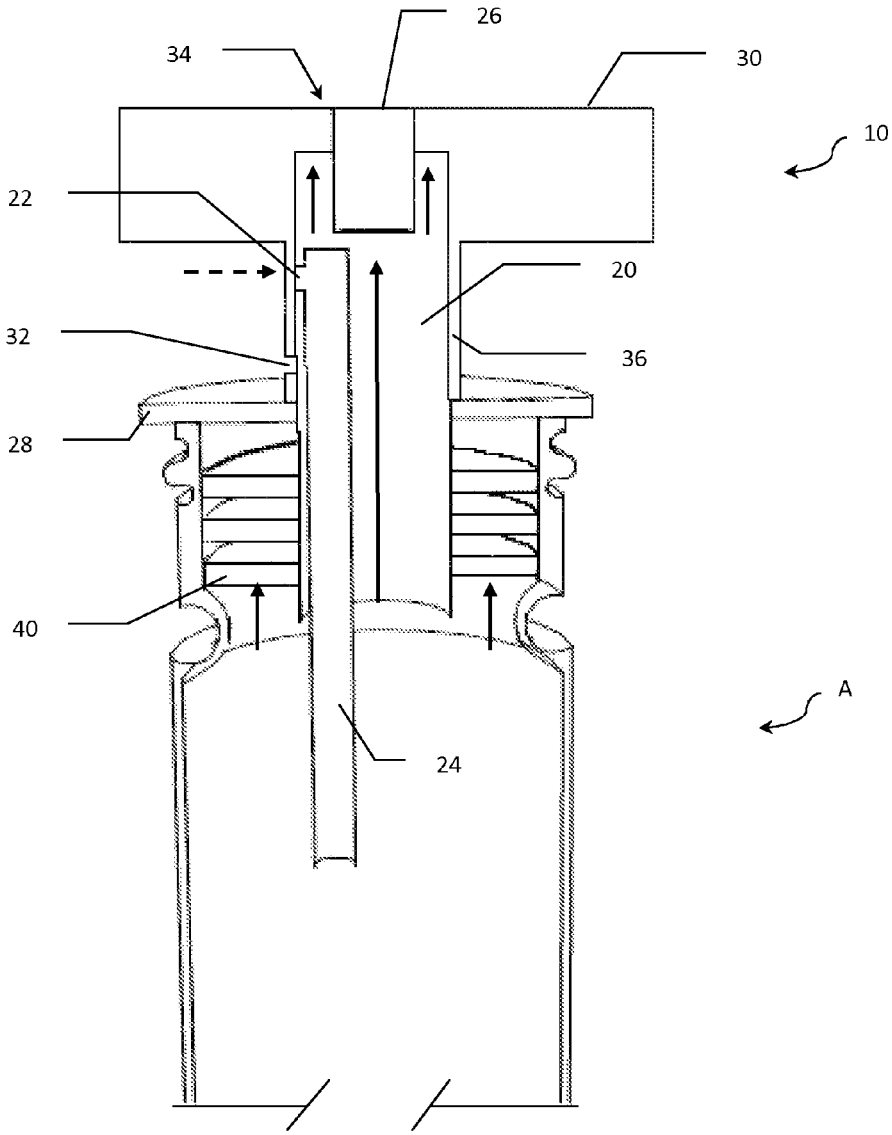
FIG. 4A is a cross-section of the inventive pour spout in the closed position.
Figure 4B:
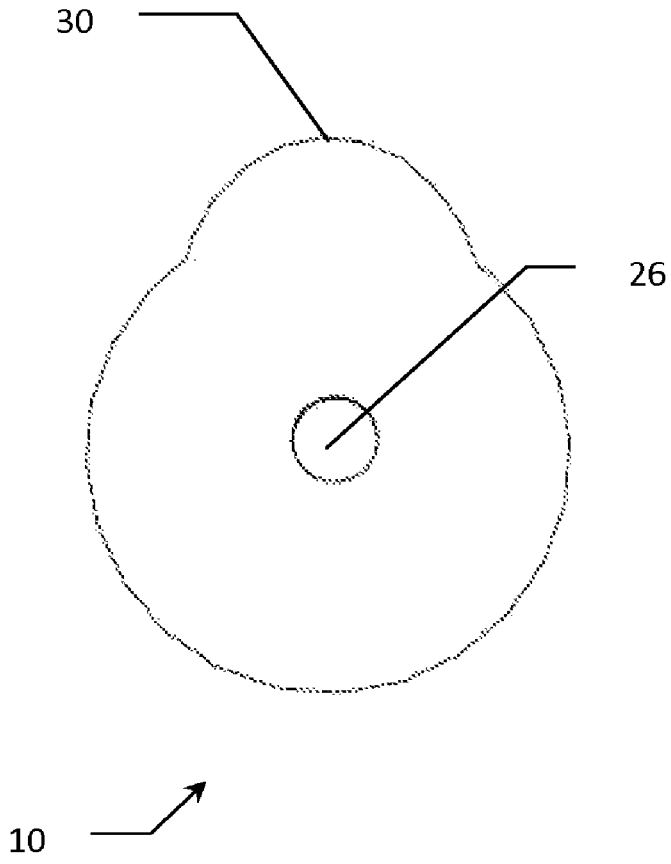
FIG. 4B is a top view of the inventive pour spout in the closed position.
Figure 4C:
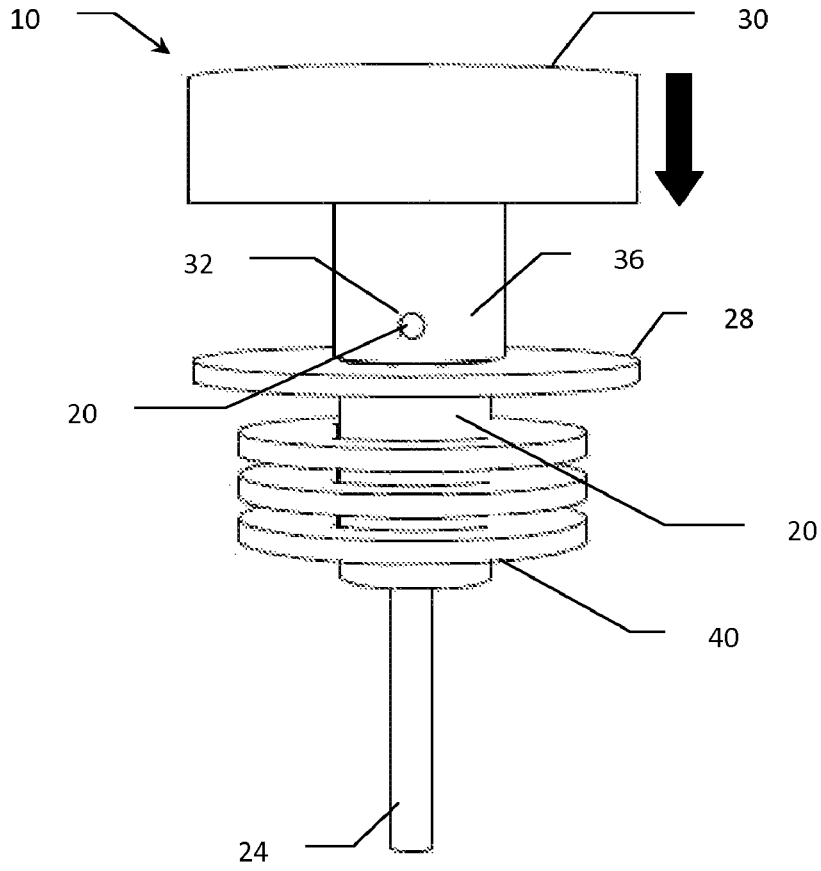
FIG. 4C is a side perspective view of the inventive pour spout in the closed position.

FIGS. 4A through 4C show pour spout 10 in the closed position. FIG. 4A is a cross-section of pour spout 10, again engaged within neck B of bottle A. Here, liquid cannot exit the spout as pour hole 34 is occluded by stopper 26 (also see FIG. 4B). Moreover, vent 24 is sealed as inner through hole 22 is occluded by the inner surface of sleeve 36. Similarly, outer through hole 36 is occluded by the outer surface of conduit 20 (also see FIG. 4B). The interior of the bottle is effectively sealed.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A pour spout, comprising:

a conduit;

a first through-hole disposed in a side of the conduit;

a vent, in fluid communication with the first through-hole;

a stopper extending to a point above the conduit;

a cap, adapted for longitudinal displacement between a first position and a second position, connected to one end of the first conduit;

a pour hole disposed in the upper surface of the cap;

a second through-hole in a side of the cap, adapted to be in fluid communication with the first through-hole when the cap is the first position.

2. The pour spout of claim 1, further comprising a lip extending from the conduit;

wherein the lip is adapted to engage the neck of a bottle when the spout is inserted therein;

and wherein the first through hole is disposed above the lip.

3. The pour spout of claim 1 wherein the pour hole is in fluid communication with the conduit when the cap is in the first position; and wherein the stopper engages the pour hole when the cap is in the second position.

4. The pour spout of claim 3 wherein the uppermost edge of the stopper is substantially planar with the uppermost surface of the cap when the cap is in the second position.

5. The pour spout of claim 1, wherein the second through-hole is occluded when the cap is the closed position.

6. The pour spout of claim 1, wherein the cap is disposed coaxially with the conduit.

7. The pour spout of claim 1, wherein the movement of the cap between the first position and the second position is substantially vertical.

8. The pour spout of claim 1 wherein the opening in the cap is centrally apertured.

9. The pour spout of claim 1 wherein the vent terminates at a position below the first conduit.

10. The pour spout of claim 1, wherein the cap has a protrusion adapted to receive the thumb of a user.

* * * * *